US012611571B2

(12) United States Patent
Shechter

(10) Patent No.: US 12,611,571 B2
(45) Date of Patent: Apr. 28, 2026

(54) DEVICE FOR STRENGTHENING MUSCLE

(71) Applicant: ARM LABZ LLC, Surfside, FL (US)

(72) Inventor: Netanel Shechter, Surfside, FL (US)

(73) Assignee: ARM LABZ LLC, Surfside, FL (US)

( * ) Notice: Subject to any disclaimer, the term of this patent is extended or adjusted under 35 U.S.C. 154(b) by 175 days.

(21) Appl. No.: 18/431,687

(22) Filed: Feb. 2, 2024

(65) Prior Publication Data

US 2024/0261631 A1 Aug. 8, 2024

Related U.S. Application Data

(60) Provisional application No. 63/443,163, filed on Feb. 3, 2023.

(51) Int. Cl.

| | |
|---|---|
| ***A63B 23/12*** | (2006.01) |
| ***A63B 21/00*** | (2006.01) |
| ***A63B 21/06*** | (2006.01) |
| ***A63B 23/14*** | (2006.01) |

(52) U.S. Cl.

CPC ..... *A63B 23/12* (2013.01); *A63B 21/06* (2013.01); *A63B 21/4035* (2015.10); *A63B 21/4049* (2015.10); *A63B 23/1281* (2013.01); *A63B 23/14* (2013.01); *A63B 21/153* (2013.01)

(58) Field of Classification Search

CPC ... A63B 21/06; A63B 21/153; A63B 21/4035; A63B 21/4049; A63B 21/00178; A63B 21/157; A63B 23/12; A63B 23/1281; A63B 23/14

See application file for complete search history.

(56) References Cited

U.S. PATENT DOCUMENTS

| | | | | |
|---|---|---|---|---|
| 4,438,920 | A | 3/1984 | Veillette et al. | |
| 5,037,087 | A | 8/1991 | Roth et al. | |
| 5,060,933 | A | 10/1991 | Cedro et al. | |
| 5,312,309 | A | 5/1994 | Fox et al. | |
| 5,380,261 | A | 1/1995 | Mora et al. | |
| 5,401,034 | A * | 3/1995 | Mallinger | A63B 21/153 473/576 |
| 5,620,398 | A | 4/1997 | Moriarty et al. | |
| 6,099,437 | A * | 8/2000 | DeMers | A63B 21/153 482/46 |
| 6,916,275 | B2 | 7/2005 | Beedy et al. | |
| 7,753,827 | B1 | 7/2010 | Emick et al. | |

(Continued)

FOREIGN PATENT DOCUMENTS

| | | | | |
|---|---|---|---|---|
| WO | WO-2012114094 A1 * | 8/2012 | ..... | A63B 23/16 |

*Primary Examiner* — Megan Anderson

(74) *Attorney, Agent, or Firm* — Law Office of Vincent LoTempio PLLC; Vincent G. LoTempio; Robert L. Cerasa

(57) ABSTRACT

Embodiments herein illustrate a device for strengthening muscles. The device includes a center rod provided with a ratchet mechanism. The center rod is configured to position a strap at a central portion of the center rod for holding a weight. A pair of handles connected to the center rod. Each handle of the pair of handles being able to rotate either in a clockwise direction or an anticlockwise direction. The strap winds up using the ratchet mechanism while rotating at least one handle of the pair of handles. Each handle of the pair of handles is connected with a pinion for blocking rotation of the ratchet mechanism. The pinion is configured to allow a quick release of the winded strap.

8 Claims, 9 Drawing Sheets

(56) References Cited

U.S. PATENT DOCUMENTS

| | | | | |
|---|---|---|---|---|
| 8,641,586 | B2 * | 2/2014 | Bremer | A63B 23/0211 482/121 |
| 10,300,331 | B2 * | 5/2019 | Seltzer | A63B 23/03516 |
| 10,569,131 | B2 | 2/2020 | Niederman et al. | |
| 12,268,914 | B2 * | 4/2025 | Young | A63B 23/12 |
| 2012/0245004 | A1 | 9/2012 | Bremer et al. | |

* cited by examiner

DEVICE FOR STRENGTHENING MUSCLE

RELATED APPLICATIONS

The present application claims the benefit of the filing date of U.S. Provisional Patent Application No. 63/443,163 filed Feb. 3, 2023, the contents of which are hereby incorporated by reference herein in its entirety.

TECHNICAL FIELD

The presently disclosed embodiments are related, in general, to devices for exercise. More particularly, the presently disclosed embodiments are related to device for strengthening muscles of wrists, elbows, and forearms.

BACKGROUND

Now days, attraction in body fitness and body building has substantially increased. Fitness has been found to enhance a sense of wellbeing as well as to fight off many diseases. Doctors have long recommended a steady exercise program to keep healthy. Further, long term health studies have concluded that exercise is beneficial to a person's mental and physical wellbeing. Thus, a muscular physique has become a new standard of an overall healthy body.

Muscles of wrists, elbows, and forearms have more importance in body fitness. These muscles are responsible for grip strength. Isometric grip strength is the ability to hold onto something, such as a barbell or a large container. Concentric grip strength is the ability to close the hand with a force against a resistance. Forearm extensors primary function is to extend the wrist. Common exercises such as bicep curls utilize forearm extensors as stabilizers, but do not isolate and exercise the forearm extensors specifically.

Forearm exercise machines are typically constructed from a piece of wood or short shaft with one side of a rope connected in the center of the shaft and the other connected to a weight. The forearm roller is a solid bar, and a user have to rotate the whole bar to get the string/strap up. A problem with the conventional forearm roller is that when winding the string/strap, the weight begins to oscillate back and forth causing an instability in the exercise. Further, hands of the user need to be adjusted to keep the winding up.

In the conventional forearm roller, when winding the strap, the user has to let go of one of the handles every rotation to continue to wind the strap. Letting go of the handles is bad especially in rehab because this will lead to compensating with the good hand. Further, the user has to let go on each hand makes the elbows bend and can results in cheating the movement. Furthermore, the user needs significantly more weight when doing the normal forearm roller because it does not purely target the forearm.

The conventional forearm gripper mainly targets the opposite side of forearm, and do not strengthen the wrist nearly as much. The conventional putty can be effective with just finger movements but cannot be used past early rehabilitation.

The conventional dumbbells are expensive and bad for home gyms because user need many weights as gets stronger. Further, the conventional dumbbells does not have the visual of strap going up.

Thus, there is a need of a device for strengthening muscles of wrists, elbows, and forearms, which may overcome above-mentioned shortcomings of the conventional forearm roller.

SUMMARY

Consequently, there is a need for an improved device for strengthening muscle that alleviates at least some of the above cited problems.

It is therefore an object of the present disclosure to provide a device for strengthening muscles of wrists, elbows, and forearms, alleviate, or eliminate all or at least some of the above-discussed drawbacks of presently known solutions.

This and other objects are achieved by the device as defined in the appended claims. The term exemplary is in the present context to be understood as serving as an instance, example or illustration.

Embodiments of the present disclosure relate to a device for strengthening muscles. The device comprises a center rod provided with a ratchet mechanism. The center rod is configured to position a strap at a central portion of the center rod for holding a weight. A pair of handles connected to the center rod. Each handle of the pair of handles being able to rotate either clockwise or anticlockwise. The strap winds up using the ratchet mechanism while rotating at least one handle of the pair of handles. Each handle of the pair of handles is connected with a pinion for blocking rotation of the ratchet mechanism. The pinion is configured to allow a quick release of the winded strap.

In an aspect, the strap is positioned over the center rod using a fastening mechanism, such as a clip and a screw.

In an aspect, each handle of the pair of handles is configured to rotate independently.

In an aspect, the pair of handles are rotatable using wrists of a user.

In an aspect, the weight is added to the strap manually.

In an aspect, each handle of the pair of handles comprises a key for locking the handle with the center rod while allowing the pair of handles to rotate.

In an aspect, each handle of the pair of handles comprises a grip made of rubber material.

In an aspect, each handle of the pair of handles is connected to the center rod through a ball bearing.

In an aspect, end of pinion acts as a switch mechanism or button that is pressed forward to release strap.

BRIEF DESCRIPTION OF DRAWINGS

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which.

DETAILED DESCRIPTION

Figure 1:
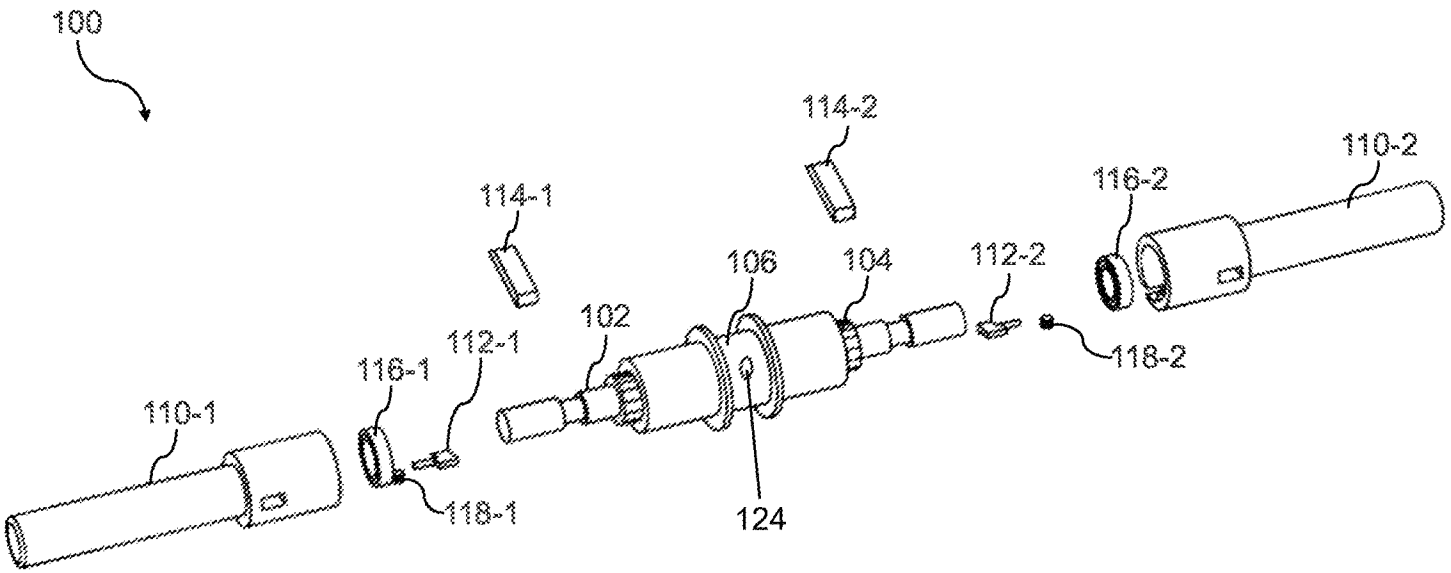
FIG. 1 illustrates an exploded view of a device for strengthening muscles, according to one or more embodiments of present invention.

Some embodiments of the present disclosure will now be described more fully hereinafter with reference to the accompanying drawings, in which some, but not all embodiments of the disclosure are shown. Indeed, these disclosures may be embodied in many different forms and should not be construed as limited to the embodiments set forth herein; rather, these embodiments are provided so that this disclosure will satisfy applicable legal requirements. Like numbers refer to like elements throughout. Terminology used in this patent is not meant to be limiting insofar as devices described herein, or portions thereof, may be attached or utilized in other orientations.

Aspects of the present disclosure will be described more fully hereinafter with reference to the accompanying drawings. The apparatus and methods disclosed herein can, however, be realized in many different forms and should not be construed as being limited to the aspects set forth herein. Like numbers in the drawings refer to like elements throughout.

Embodiments of the present disclosure will be described and exemplified more fully hereinafter with reference to the accompanying drawings. The solutions disclosed herein can, however, be realized in many different forms and should not be construed as being limited to the embodiments set forth herein.

The term "comprising" means including but not limited to, and should be interpreted in the manner it is typically used in the patent context. Use of broader terms such as "comprises," "includes," and "having" should be understood to provide support for narrower terms such as "consisting of," "consisting essentially of," and "comprised substantially of." As used herein, the singular forms "a", "an" and "the" are intended to include the plural forms as well, unless the context clearly indicates otherwise.

The phrases "in one embodiment," "according to one embodiment," and the like generally mean that the particular feature, structure, or characteristic following the phrase may be included in at least one embodiment of the present disclosure, and may be included in more than one embodiment of the present disclosure (importantly, such phrases do not necessarily refer to the same embodiment).

The word "exemplary" is used herein to mean "serving as an example, instance, or illustration." Any implementation described herein as "exemplary" is not necessarily to be construed as preferred or advantageous over other implementations.

If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

Figure 7:
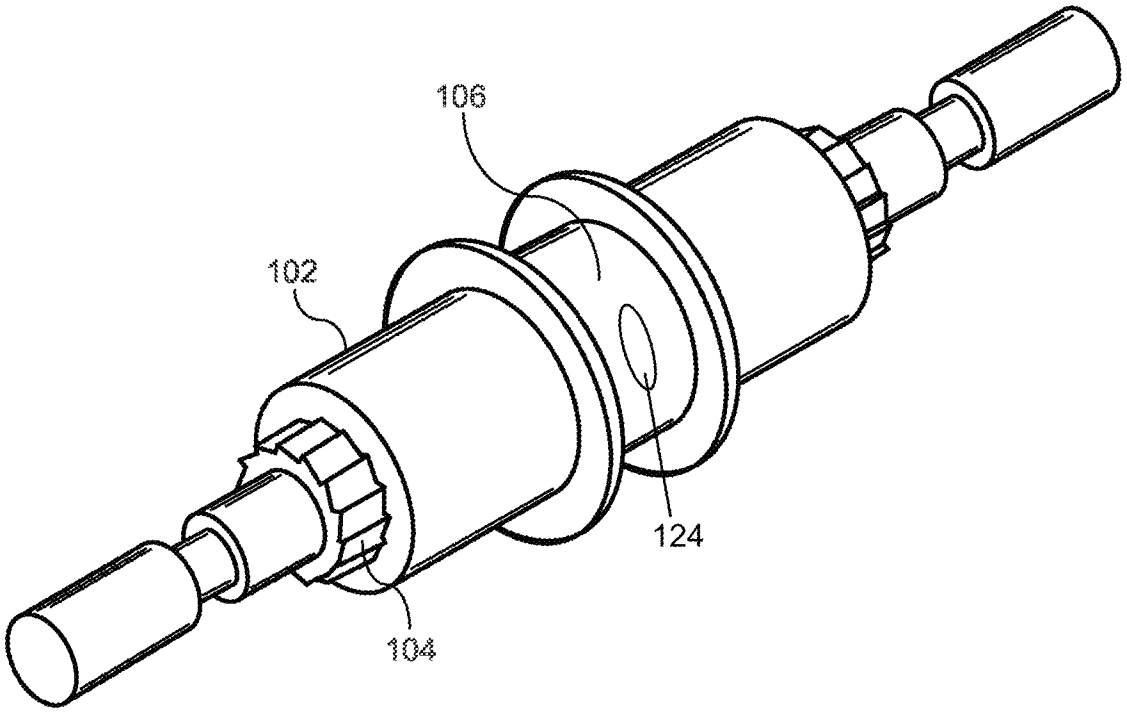
FIG. 7 illustrates a perspective view of a center rod utilized in the device, according to one or more embodiments of present invention.

FIG. 1 illustrates an exploded view of a device 100 for strengthening muscles, according to one or more embodiments of present invention. The device 100 may include a center rod 102 provided with a ratchet mechanism 104. For example, either side of the center rod 102 may have a ratchet. In an embodiment, ratchet mechanism 104 is part of the center rod 102 as one piece. A perspective view of the center rod 102 is illustrated in FIG. 7. The ratchet mechanism 104 may have one-way design for allowing rotation is one direction and blocking movement in opposite direction. The center rod 102 may be configured to position a strap 106 at a central portion of the center rod 102. The strap 106 may be positioned over the center rod 102 coupled with a fastening mechanism 124.

Figure 6:
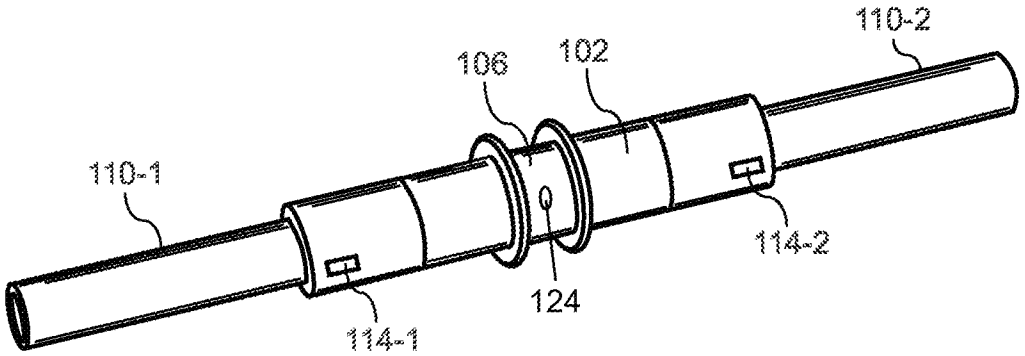
FIG. 6 illustrates a perspective view of a device for strengthening muscles with side handles attached to the center rod.
Figure 8:
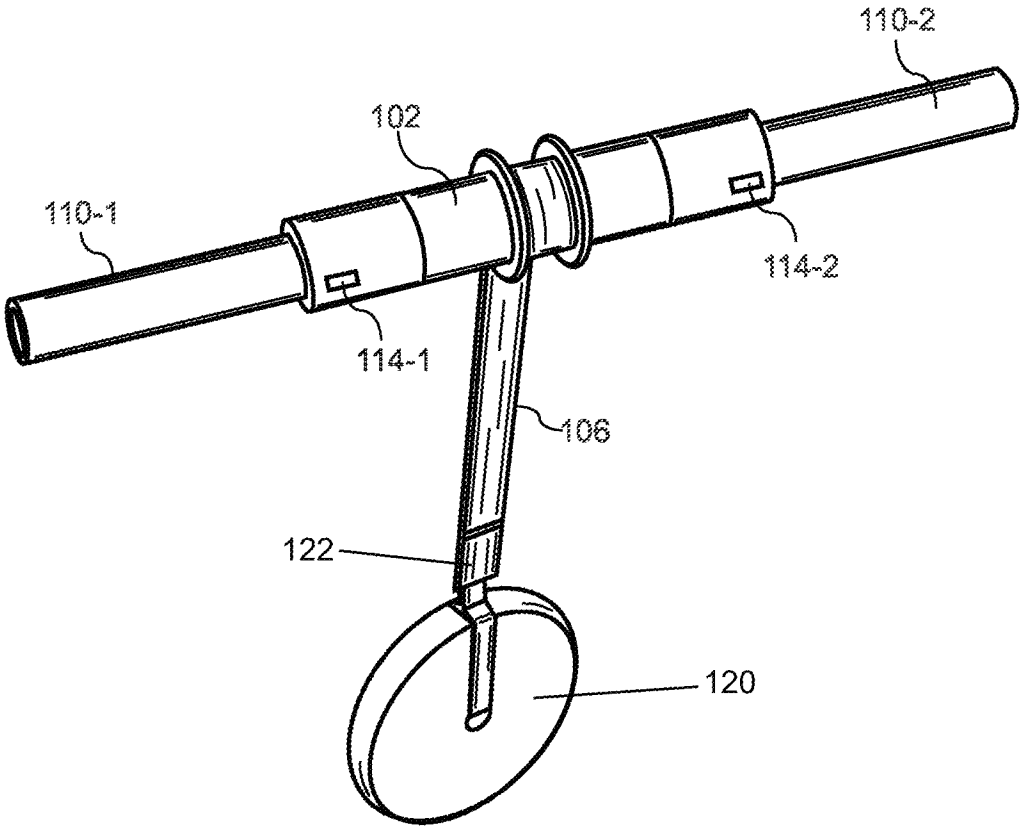
FIG. 8 illustrates a perspective view of a device for strengthening muscles with weight attached, according to one or more embodiments of present invention.
Figure 9:
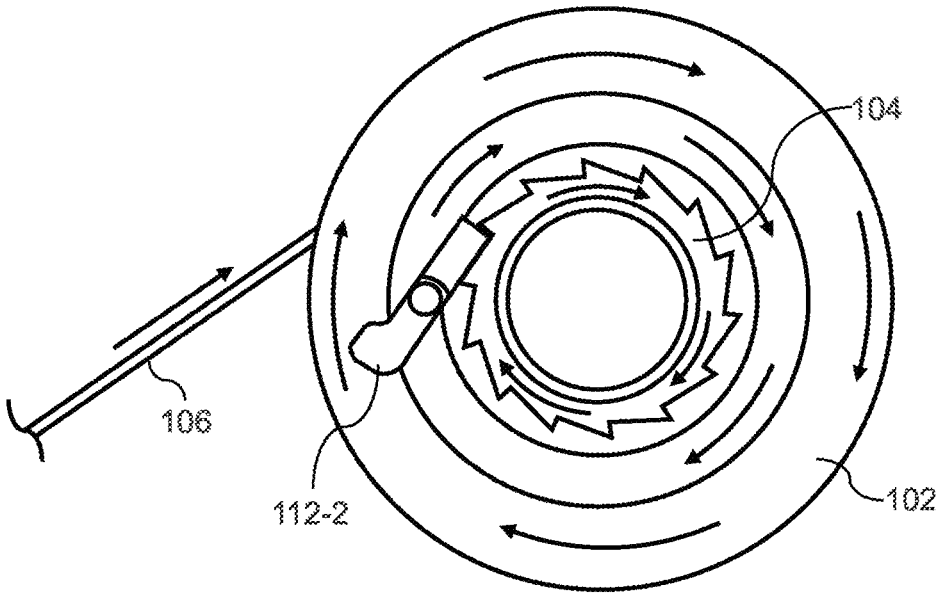
FIG. 9 illustrates a sectional view of a device for strengthening muscles in a wind up position, according to one or more embodiments of present invention.

The device 100 may further comprise a pair of handles, such as a left handle 110-1 and a right handle 110-2. A perspective view of a left handle 110-1 and right handle 110-2 attached to a center rod 102 is illustrated in FIG. 6. The pair of handles 110 may rotate independently. Each handle of the pair of handles 110 may be able to rotate either in a clockwise direction or in an anticlockwise direction. The pair of handles may be rotated using wrists of a user. The strap 106 may wind up using the ratchet mechanism 104 while rotation at least one handle of the pair of handles 110. A sectional view of the strap 106 being wound up using a ratchet mechanism 104 is illustrated in FIG. 9. A weight 120 may be added to the strap 106 manually. A perspective view of weight 120 added to strap 106 is illustrated in FIG. 8.

Figure 10:
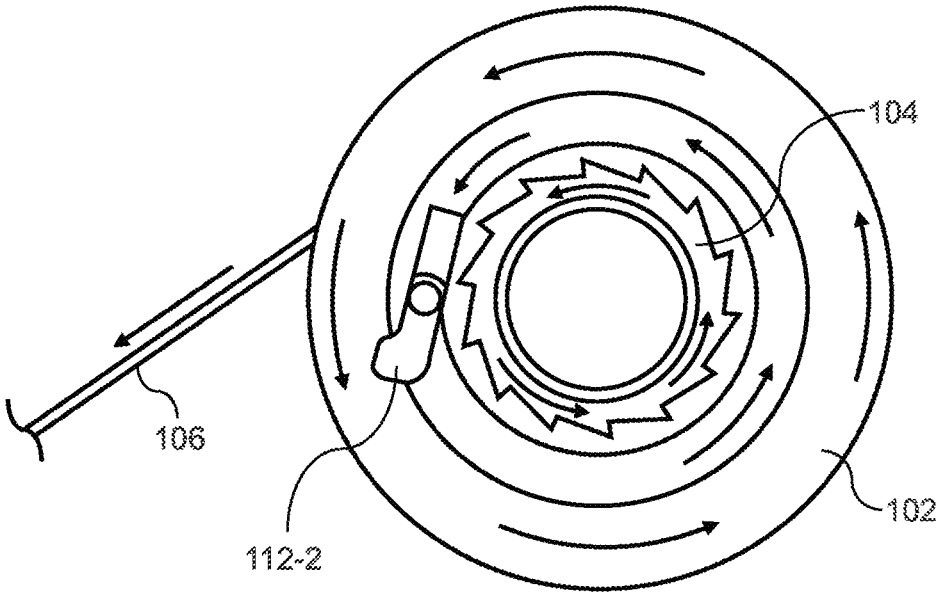
FIG. 10. illustrates a sectional view of a device for strengthening muscles in a quick release position, according to one or more embodiments of present invention.

Each handle of the pair of handles 110 may be connected with a pinion 112 for blocking rotation of the ratchet mechanism 104. For example, a left-side pinion 112-1 may be provided with the left handle 110-1 and a right-side pinion 112-2 may be provided with the right handle 110-2. The pinion 112 may be configured to allow a quick release of the winded strap 106. A sectional view of the strap 106 being released using a ratchet mechanism 104 is illustrated in FIG. 10.

Each handle of the pair of handles 110 may comprise a key 114 for locking the handle with the center rod 102 while allowing the pair of handles 110 to rotate. The key 114 may act as a locking mechanism. For example, a left-side key 114-1 may be provided with the left handle 110-1 and a right-side key 114-2 may be provided with the right handle 110-2. In another implementation, a screw may be utilized as the locking mechanism for locking the handle with the center rod 102. In another implementation, other similar mechanism may be utilized for locking the handle with the center rod 102.

Each handle of the pair of handles 110 may comprise a grip made of rubber material. Each handle of the pair of handles 110 may be connected to the center rod 102 through a ball bearing 116. For example, a left-side ball bearing 116-1 may be provided with the left handle 110-1 and a right-side ball bearing 116-2 may be provided with the right handle 110-2. The ball bearing 116 may allow each handle of the plurality of handles 110 to spin smoothly.

In operation, the pinion 112 protrudes out of the handle 110 and may act as a switch mechanism. When a user presses on the pinion 112, it will press against a spring 118, away from the ratchet allowing a quick release of the winded strap 106.

Figure 2:
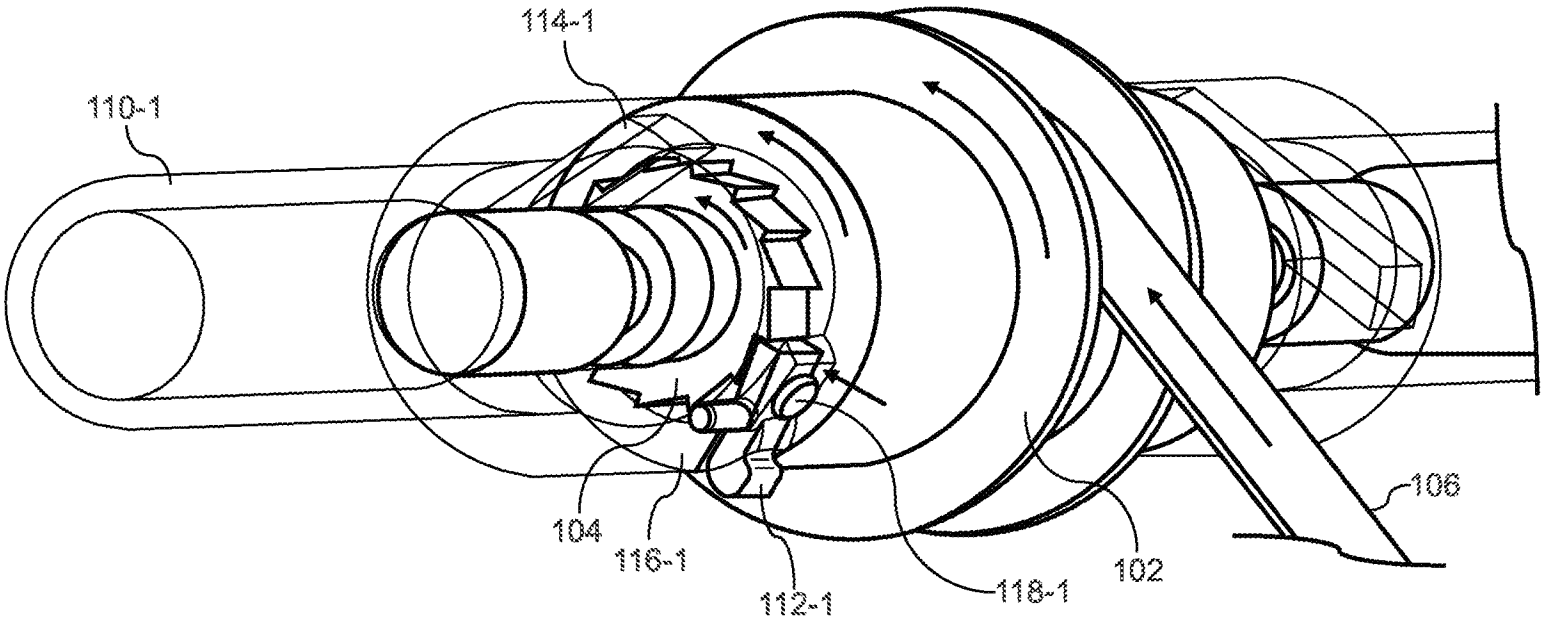
FIG. 2 illustrates a side perspective view of a device for strengthening muscles illustrating a strap component being wound up, according to one or more embodiments of present invention.

As shown in FIG. 2, the left-side pinion 112-1 protrudes out of the left handle 110-1 and may act as a switch mechanism, held in place by left-side spring 118-1. While a pinion 112 sticks out of a handle 110, handle 110 may be rotated either in a clockwise direction or in an anticlockwise direction. The strap 106 may wind up using the ratchet mechanism 104 while rotation at least one handle of the pair of handles 110.

Figure 3:
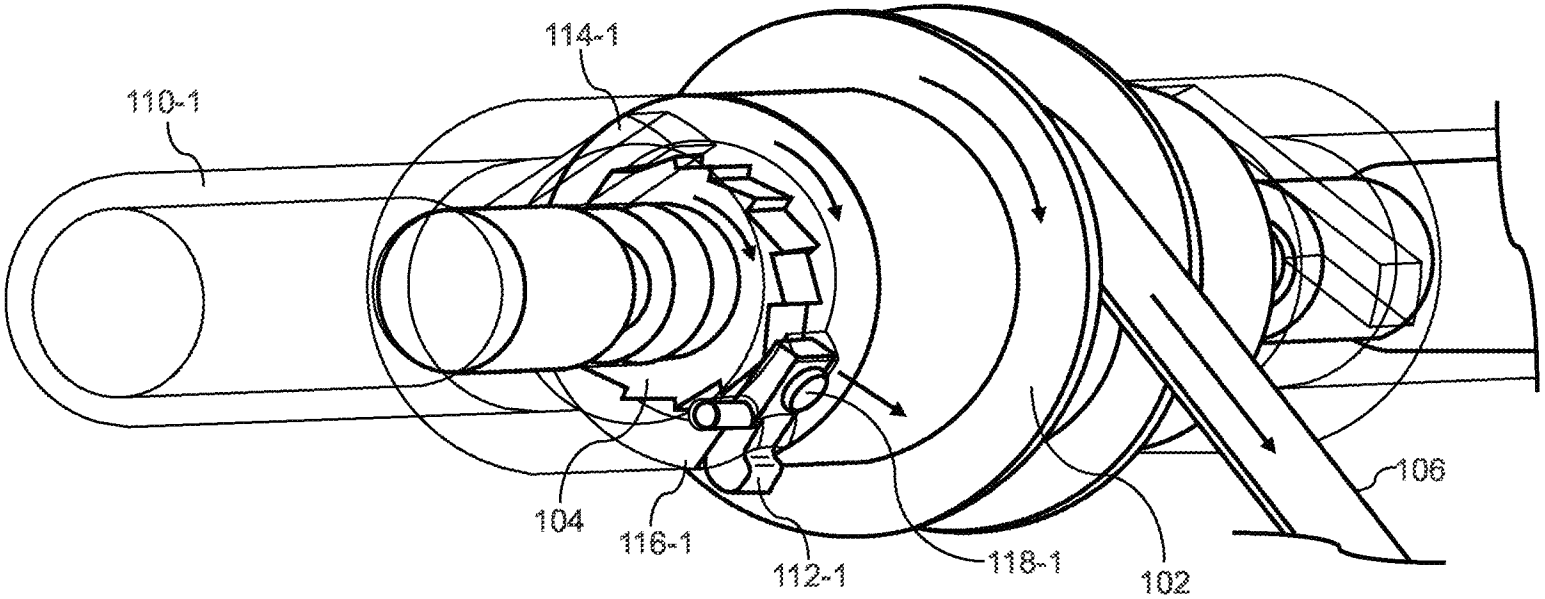
FIG. 3 illustrates a side perspective view of a device for strengthening muscles illustrating a strap component being released, according to one or more embodiments of present invention.
Figure 4:
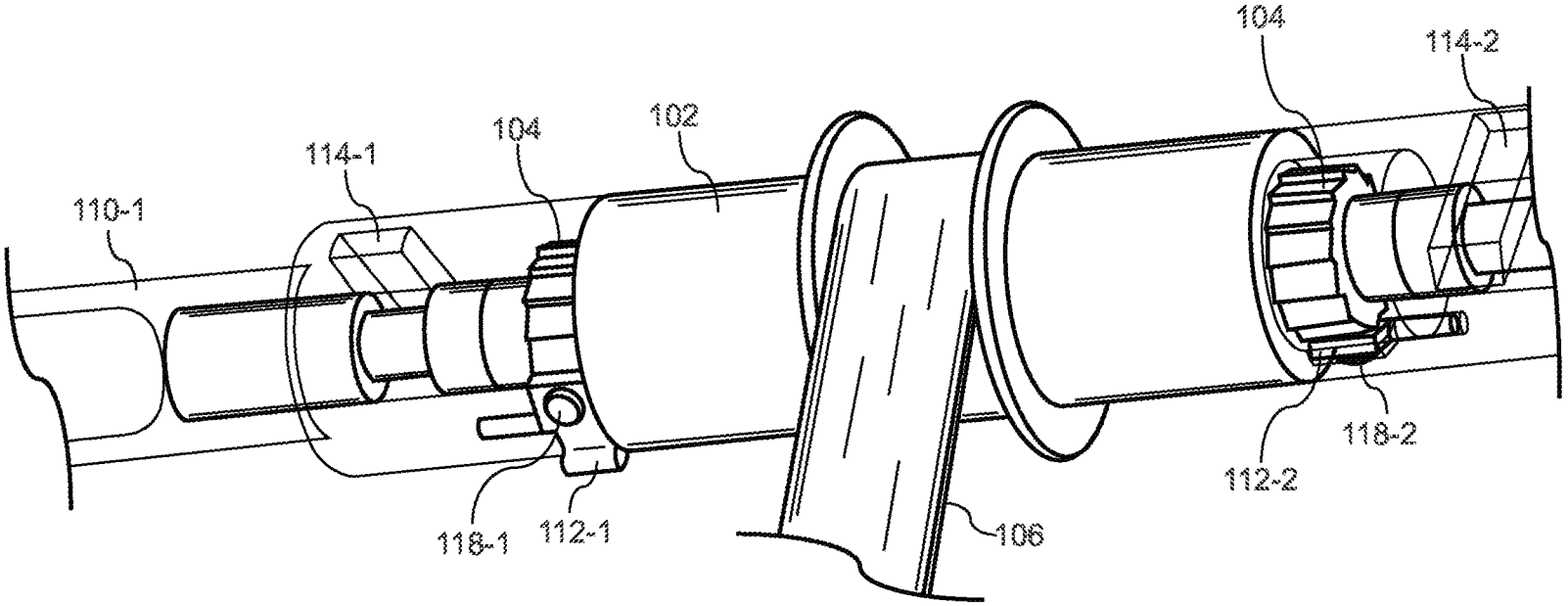
FIG. 4 illustrates a front perspective view of a device for strengthening muscles, according to one or more embodiments of present invention.

FIG. 3 illustrates another embodiment of the device 100 shown in FIG. 2 with left-side pinion 112-1 pressed in. When a user presses on the pinion 112, the pinion presses against a spring 118, away from the ratchet mechanism 104 allowing a quick release of the winded strap 106. FIG. 4 is a frontal perspective view of the device 100 in FIG. 3 illustrating the ratchet mechanism 104 and pinion 112 on the left and right sides of the center rod 102.

Figure 5:
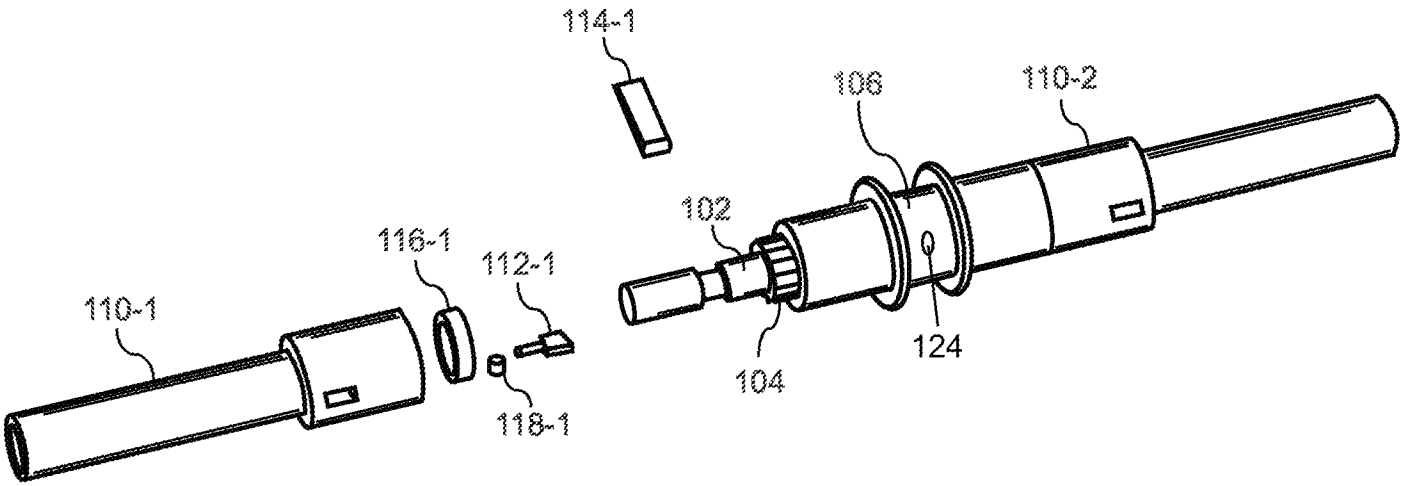
FIG. 5 illustrates an exploded view of a device for strengthening muscles with a side handle attached to the center rod, according to one or more embodiments of present invention.

FIG. 5 illustrates an alternate exploded embodiment of the device 100 in FIG. 1. In this embodiment, the left side of the center rod 102 is an exploded view and the right side of the center rod 102 displays the right handle 110-2 attached to the center rod 102. This view demonstrates how the handle 110 fits over the center rod 102, ball bearing 116, pinion 112, spring 118, and ratchet mechanism 104.

FIG. 6 and FIG. 8 illustrate a view of device 100 with left handle 110-1 and right handle 110-2 attached to the center rod 102. In FIG. 6, strap 106 is wound around the center rod 102 and positioned by fastening mechanism 124. FIG. 8 demonstrates the device in FIG. 6 with strap 106 unwound and weight 120 attached to end of the strap 106. In this embodiment, users of the device 100 may add different weights to the strap 106. In an embodiment, the distal end of the strap is secured to the strap 106 using a fastener 122.

FIG. 7 illustrates the center rod 102 with a strap 106 positioned over the center rod 102 positioned using a fastening mechanism 124. In this embodiment, ratchet mechanism 104 is fitted on both left and right side of the center rod 102.

FIG. 9 and FIG. 10 illustrate a sectional view of a device 100 for strengthening muscles, according to one or more embodiments of present invention. As in previous embodiments, the device 100 may include a center rod 102 provided with a ratchet mechanism 104. As illustrated in FIG. 9, the strap 106 may wind up as the ratchet mechanism 104 rotates and pinion 112 is in contact with the ratchet mechanism 104. In this view, the right-side pinion 112-2 is in contact with ratchet mechanism 104. The ratchet mechanism 104 is coupled with the center rod 102 and right-side pinion 112-2. When pinion 112-2 is in contact with ratchet mechanism 104, users may rotate handle 110 in clockwise or anticlockwise direction. FIG. 10 illustrates the device used in FIG. 9 with right-side pinion 112-2 pressed in by user. In this embodiment, the right-side pinion 112-2 moves away from the ratchet mechanism 104 allowing the strap 106 to unwind from the center rod 102.

There are a couple of ways to treat wrist, forearm, and elbow injuries. The proposed device 100 a unique way to target forearms to help prevent or rehabilitate injuries. The proposed device 100 is good for everyone at all levels at home, at a gym, or at a rehabilitation/physical therapy center. There are couple key reasons our product is the best. The user never has to let go of the handle.

There is a clicking sound every degree of rotation. Having a clicking noise can make the user hit a certain number of clicks on each rotation. Clicking will allow the user to stay at a number or steadily increase the clicking to show progress of mobility and strength of the forearm and wrist. The user can rotate one hand at a time to target the injured hand individually. Further, the user can wind the strap by alternating the rotation of the handles. On the contrary to the conventional roller, the user does not have to let go of the handles when the user uses proposed device 100. Not letting go will allow the user to use significantly less weight by purely targeting the intended muscles.

Using the proposed device 100, it will be effortless to train forearms, and the user can get muscular forearms. The same benefits as the rehab are applicable to fitness with slightly more weight needed at higher levels.

The embodiments herein and the various features and advantageous details thereof are explained with reference to the non-limiting embodiments in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the scope of the disclosure.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

Therefore, while the embodiments herein have been described in terms of preferred embodiments, those skilled in the art will recognize that the embodiments herein can be practiced with modification within the spirit and scope of the embodiments as described herein.

Many modifications and other embodiments of the inventions set forth herein will come to mind to one skilled in the art to which these inventions pertain having the benefit of teachings presented in the foregoing descriptions and the associated drawings. Although the figures only show certain components of the apparatus and systems described herein, it is understood that various other components may be used in conjunction with the supply management system. Therefore, it is to be understood that the inventions are not to be limited to the specific embodiments disclosed and that modifications and other embodiments are intended to be included within the scope of the appended claims. Moreover, the steps in the method described above may not necessarily occur in the order depicted in the accompanying diagrams, and in some cases one or more of the steps depicted may occur substantially simultaneously, or additional steps may be involved. Although specific terms are employed herein, they are used in a generic and descriptive sense only and not for purposes of limitation.

What is claimed is:

1. A device for strengthening muscles, comprising:

a center rod provided with a ratchet mechanism, wherein the center rod is configured to position a strap at a central portion of the center rod for holding a weight;

a pair of handles connected to the center rod, each handle of the pair of handles being able to rotate either in a clockwise direction or an anticlockwise direction, wherein the strap winds up using the ratchet mechanism while rotating at least one handle of the pair of handles, each handle of the pair of handles is connected with a pinion for blocking rotation of the ratchet mechanism, and the pinion is configured to allow a quick release of the strap wherein the pinion is directly pressable to disengage from the ratchet mechanism to allow the quick release of the strap.

2. The device of claim 1, wherein the strap has a proximal end and a distal end.

3. The device of claim 2, wherein the proximal end of the strap is positioned at a central portion of the center rod.

4. The device of claim 2, wherein the distal end comprises a fastener.

5. The device of claim 1, wherein the pinion comprises a switch mechanism or a button pressed to release the strap.

6. The device of claim 1, wherein the center rod is monolithic.

7. The device of claim 1, wherein the center rod comprises separate sections having at least two detachably joinable end portions.

8. A method for strengthening muscles, the method comprising:

positioning a strap at a central portion of a center rod;

coupling the strap to the center rod using a fastening mechanism;

adding, to a distal end of the strap, a weight;

securing, using a fastener, the distal end of the strap to the strap;

rotating, a pair of handles, clockwise or anticlockwise;

winding, upward, the strap;

pressing, downward, a pinion;

releasing, downward, the strap; and repeating the steps of winding the strap upward and releasing the strap downward based on an individual's preferences.

* * * * *